US005389021A

United States Patent [19]

Padgett

[11] Patent Number: 5,389,021

[45] Date of Patent: Feb. 14, 1995

[54] MOTORBOAT PROPELLER SAFETY SHROUD

[76] Inventor: James A. Padgett, 802 Iowa St., Salem, Va. 24153

[21] Appl. No.: 123,938

[22] Filed: Sep. 20, 1993

[51] Int. Cl.[6] ..... B63H 11/00

[52] U.S. Cl. ..... 440/67; 440/71

[58] Field of Search ..... 114/166, 145 R; 440/66, 440/67, 68, 69, 70, 71, 72, 88; 60/221; 415/208.1, 228; 416/179, 189

[56] References Cited

U.S. PATENT DOCUMENTS

| | | | |
|---|---|---|---|
| 2,139,594 | 12/1938 | Kort | 114/166 |
| 2,551,371 | 5/1951 | Grigg | 440/71 |
| 3,066,893 | 12/1962 | Mercier | 440/67 |
| 3,658,028 | 4/1972 | Koons | 440/67 |
| 3,842,786 | 10/1974 | Uroshevich | 440/67 |
| 3,885,516 | 5/1975 | Uroshevich et al. | 440/88 |
| 4,680,017 | 7/1987 | Eller | 440/66 |
| 4,694,645 | 9/1987 | Flyborg et al. | 114/166 |

FOREIGN PATENT DOCUMENTS

| | | | |
|---|---|---|---|
| 925209 | 7/1949 | Germany | 440/67 |
| 1202873 | 8/1970 | Germany | 440/67 |

OTHER PUBLICATIONS

"Report of the Propeller Guard Subcommittee" by The National Boating Safety Adulsory Council, Nov. 7, 1989.

*Primary Examiner*—Stephen P. Avila
*Attorney, Agent, or Firm*—Jones, Tullar & Cooper

[57] ABSTRACT

A protective enclosure and propulsive system for a motor-driven multi-bladed marine propeller includes a shroud housing which is positioned about the propeller that rotates on its axial through bore, the shroud, providing a safety barrier for the propeller and its underwater enviroment, while also improving the thrust of the propeller by having a converging exit cone containing a horizontal control vane between the sides of this cone, where the cone and control vane both extend rearward of the propeller and at the same negative angle relative to the shroud's centerline.

6 Claims, 2 Drawing Sheets

FIG. 1
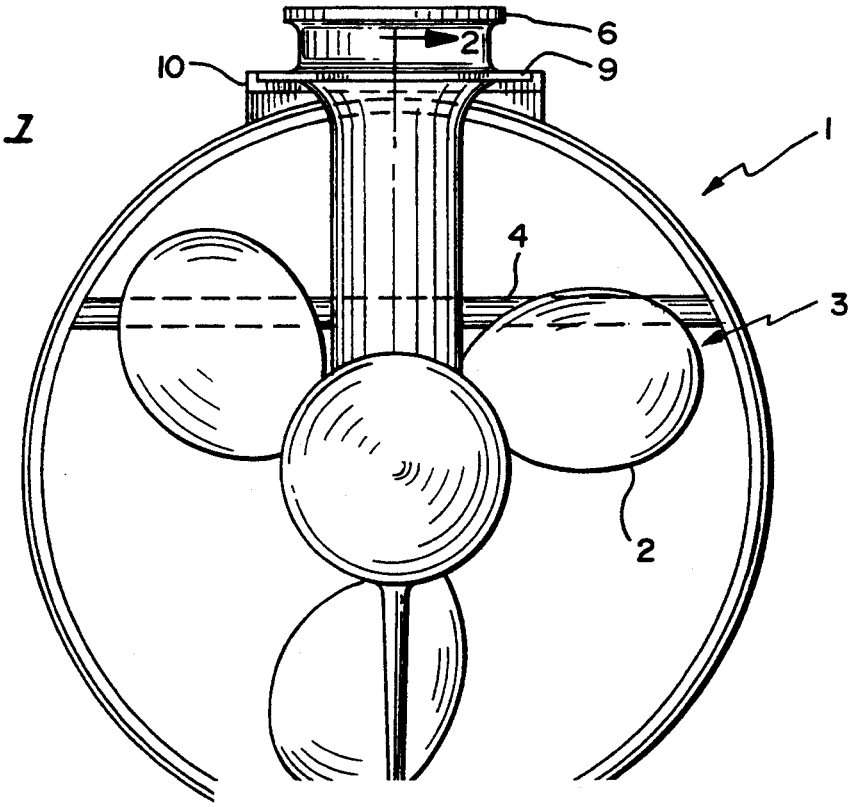
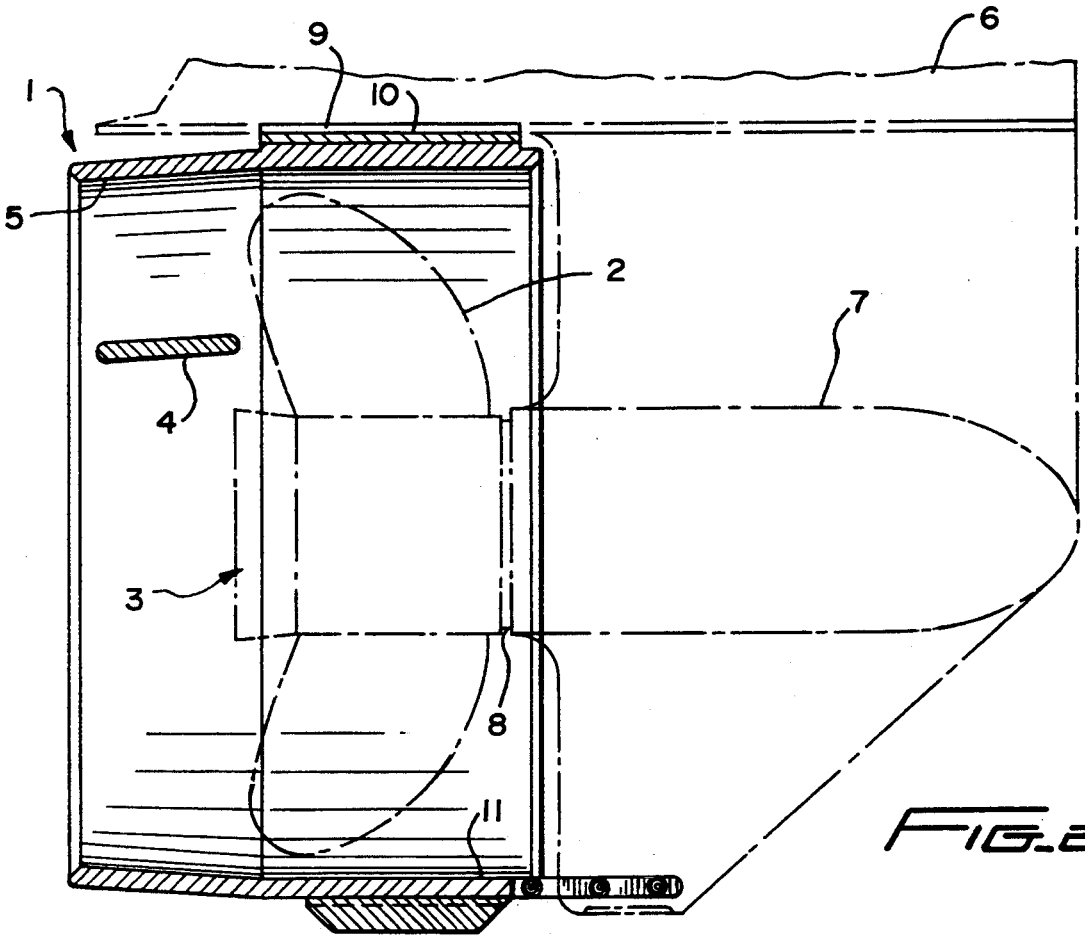
FIG. 2

MOTORBOAT PROPELLER SAFETY SHROUD

BACKGROUND OF THE INVENTION

For over 50 years, shrouded or nozzled propellers have been in use by the marine industry as a means of propulsion for slow speed craft such as tug boats, tankers, river pushboats and floating platforms or docks. Because of their configuration and size, this kind of craft use high pitch, slow RPM propellers (usually less than 200 RPM) and the adaptation of a shroud type enclosure has resulted in an improvement in thrust over a non-enclosed propeller of the same pitch and which diameter, turning at the same RPM. With the introduction of high speed motorboats by the recreational boating industry for water skiing, fishing and the like, the use of high RPM motor drives have been necessary to propel such craft at speeds of 50 miles per hour or better (with propellers rotating at speeds up to 5000 RPM). To date, numerous devices, such as; ring band guards, screens and propeller tunnels, have been tried for increasing thrust and for providing safety from the exposed propeller, with the result of increased drag, reduced performance and the dissatisfaction of their operators, who generally have refused their use.

The U.S. Coast Guard, National Boating Safety Advisory Council and numberable Audubon groups have requested the development for these high speed motorboats of a safety guard for the exposed propellers in order to protect swimmers and water skiers, as well as underwater wild live, such as, the endangered manatee and plant growth that is otherwise needed as food and habitat for other local wild live.

The propeller safety shroud of this invention protects exposed people and wild life against harm and provides a simple, low cost device that can easily be installed on existing and which new drive systems and will also improve the craft's performance.

SUMMARY OF THE INVENTION

An object of the present invention is to provide an improved motorboat propeller safety shroud which develops a constant pressure field over the full surface of the propeller blades, regardless of the propeller's RPM, and contains in its rear converging cone a horizontal control vane for providing maximum vertical lift to the stern of the craft thus allowing the craft to achieve a "planing" position on start-up and to remain in this mode on deceleration.

Another object of the invention is to provide a motorboat propeller safety shroud that eliminates the "rooster tail" of water coming off the propeller, allows high speed turns of the craft without propeller slippage or cavitation, and increases the craft's maneuverability at slow speeds in both forward and reverse directions.

An additional object of the invention is to provide an improved marine propeller safety shroud which, while designed primarily for outboard and stern drive type of propulsion system, can also be applied to boats having an inboard engine powering a shaft passing through the hull to a strut-mounted propeller, where in both cases, any increase in drag due to this safety shroud is compensated by the increase in thrust due to the safety shroud's unique design and with proper selection of the propeller's pitch.

Other objects and advantages of the invention will appear hereafter in the detailed description and will be particularly pointed out in the appended claims and be illustrated in the accompanying drawings, in which:

FIGURE DESCRIPTION

FIG. I is a front elevation view of a preferred embodiment of the improved marine propeller safety shroud of the present invention;

FIG. 2 is a vertical sectional view, taken along lines 2—2 of FIG. 1;

DETAILED DESCRIPTION

Figure 3:
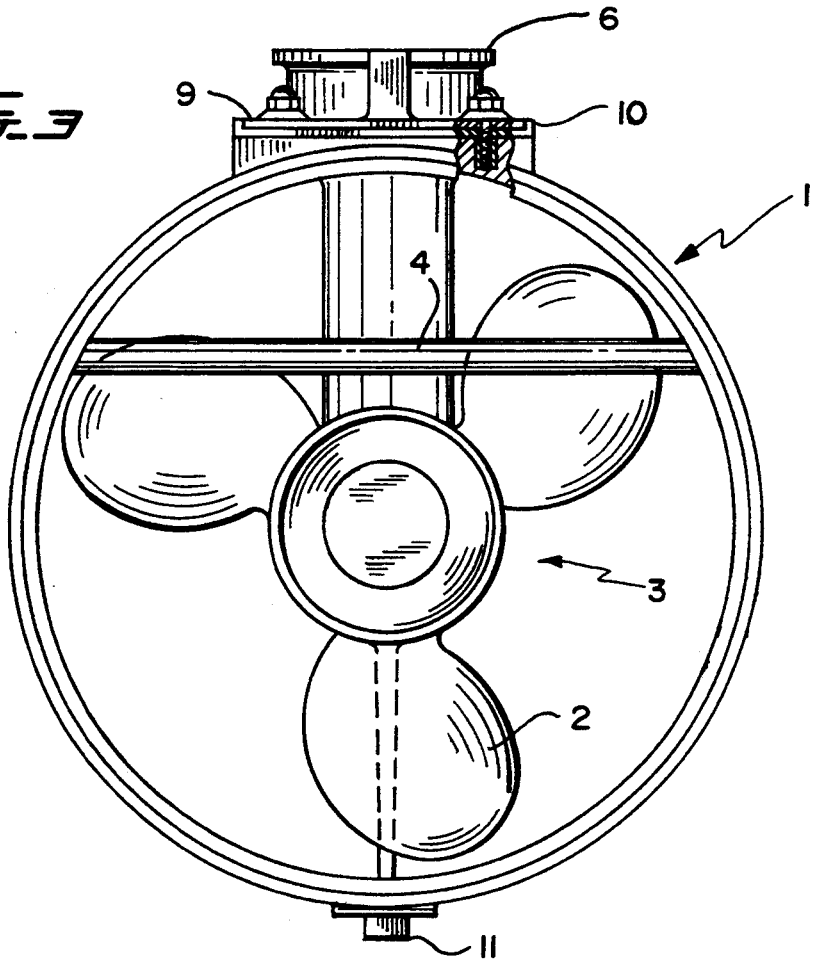
FIG. 3 is a rear elevation view of the safety shroud of FIG. 1.

Referring now in detail to the drawings in which like reference characters designate like parts, the improved motorboat propeller safety shroud 1 of the present invention is particularly design as a unique hydraulic enclosure adapted to maintain a relatively constant pressure field over the full surface of the blades 2 of the propeller 3 while the propeller is rotating at any speed. By holding this pressure field constant, the improved safety shroud captures the increased water flow from the propeller and directs this flow over a lift control vane 4 and through a converging exit cone 5 without any cavitation occurring to the water stream in its passage through the safety shroud.

The controlled water flow effected by the shroud 1 produces several major improvements in the performance of a craft so equipped. These include the prompt lifting of the stern of the boat to a "planing" position after full throttle start-up and holding the boat in that position longer after deceleration, elimination of the "rooster tail" effect of water being thrown into the air by the propeller when the propeller is turning at a higher speed than the boat is accelerating, allowance of high speed turns without propeller slippage or cavitation, and increased maneuverability of the boat at slow speeds in both forward and reverse directions.

In the drawings, the improved motorboat propeller safety shroud 1 has been illustrated mounted to a gear case propeller drive unit 6 of a type common to both outboard and stern drive boating propulsion systems. In such systems, the propeller is driven through a vertical drive shaft (not shown) to a right angle drive housing 7 turning a horizontal drive shaft 8 mounting the propeller 3. The housing 7 also provides a horizontal cavitation plate 9 parallel to the propeller drive shaft 8 that prevents air from being sucked downward by the rotating propeller. The safety shroud 1 is mounted through a shim plate 10 of a thickness to provide the proper concentricity of the safety shroud 1 to the propeller and a skid plate/mounting bracket 11 is mounted on the bottom of the safety shroud to protect it from damage by underlying foreign objects.

Basically, the improved motorboat propulsion system of the present invention is comprised of an open-ended cylindrical safety shroud 1, concentrically housing a multi-bladed propeller 3 and having a tapered or converging exit cone 5 containing beyond the propeller a horizontal control vane 4. However, as indicated in drawing FIG. 4 the several elements of the safety shroud and propeller, to function as intended, have for each symbol the relative dimensional values as listed in the following table:

TABLE 1

RELATIVE DIMENSIONAL VALUES OF SAFETY SHROUD AND PROPELLER

| Dimension Symbol | Minimum Value | Maximum Value | Preferred Value |
|---|---|---|---|
| Pc | 0.50 in. | 0.75 in. | 0.50 in. |
| | 1.27 cm | 1.90 cm | 1.27 cm |
| Si | 0.50 in. | none | 1.00 in. |
| | 1.27 cm | | 2.54 cm |
| Scc | 0.50 in. | 0.75 in. | 0.50 in. |
| | 1.27 cm | 1.90 cm | 1.27 cm |
| Angle A° | −3.0° | −4.0° | −3.5° |
| Lcc | 3.0 in. | 5.0 in. | 4.0 in. |
| | 7.62 cm | 12.7 cm | 10.16 cm |
| Ccv | 0.50 in. | 0.75 in. | 0.50 in. |
| | 1.27 cm | 1.90 cm | 1.27 cm |
| Hcv | — | — | .25 Did |
| CLc | ±0.00 in. | ±0.125 in. | ±0.062 in. |
| | ±0.00 cm | ±0.32 cm | ±0.16 cm |

Figure 4:
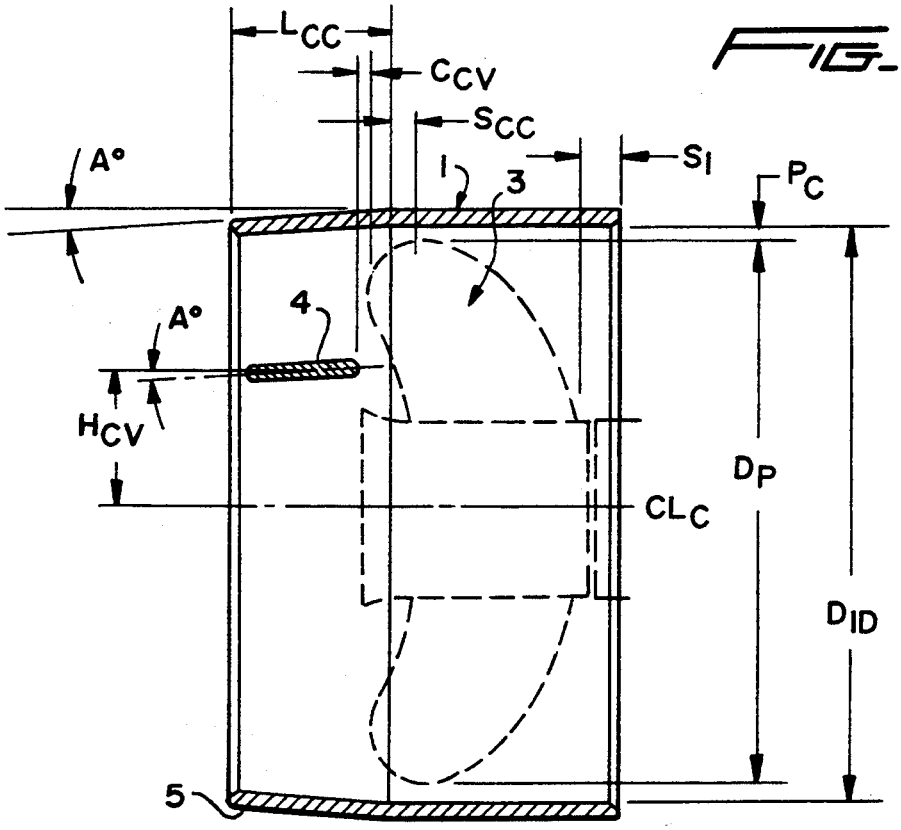
FIG. 4 is a fragmentary vertical sectional view on the section of FIG. 2, depicting in terms of dimensional symbols, the relative dimensions of the certain parts of the safety shroud and the enclosed propeller.

Symbols shown in drawing FIG. 4, are as follows Dp is the propeller diameter and Did is the inside diameter of the improved propeller safety shroud.

Dimension Pc is the clearance between the propeller maximum diameter and the safety shroud inside diameter. If this clearance is less than 0.50 inches it will cause cavitation, if greater than 0.75 inches, it will reduce the pressure field around the propeller and thus lose maximum thrust.

The dimension Si is the location of the safety shroud inlet upstream relative to the leading edge of the propeller blades. If less than 0.50 inch, it reduces the propeller pressure field and excessive length of this dimension will reduce the water flow to the propeller.

Dimension Scc locates the internal starting point of the safety shroud exit cone downstream of the propeller blade outer tip If less than 0.50 inches, it will cause cavitation, if greater than 0.75 inches it starts to reduce the maximum thrust from the propeller.

Angle A° is the angle of convergence of the converging exit cone and the angle of declination of the control vane relative to the safety shroud's centerline. If less than −3° it causes loss of thrust and lift from the horizontal control vane, if greater than −4° it begins to restrict the water flow through the exit cone.

Dimension Lcc is the length of the safety shroud's exit cone from its starting point to a shroud exit edge. If less than 3.0 inches it will cause loss of forward thrust, if greater than 5 inches it will restrict water flow through the exit cone.

Dimension Ccv is the clearance between the back edge of the propeller blades and the leading edge of the horizontal control vane. If this clearance is less than 0.50 inches, it will cause cavitation and loss of lift by the control vane, if greater than 0.75 inches it positions the control vane too far back to achieve maximum lift.

Dimension Hcv is the height of the horizontal control vane from the centerline of the safety shroud. This location is critical for maximum lift, any deviation from this point will reduce lift efficiency. As set forth in Table 1, the control vane is located halfway between the centerline of the shroud and the upper, inner surface of the shroud.

Dimension CLc is the concentricity allowance between the propeller and safety shroud centerlines. The maximum permissible misalignment is ±0.125 inches and if this limit is exceeded, serious cavitation and loss of optimum performance will result.

From the above detailed description it will be apparent that there has been provided an improved motorboat propeller safety shroud which is of simple design and low cost in construction and which is readily made of cast metal, such as aluminum, or molded from high impact thermoplastics, such as glass impregnated nylon or other high strength composition plastics.

It should be understood that the described and disclosed embodiment is merely exemplary of the invention and that all modifications are intended to be included that do not depart from the spirit of the invention and the scope of the appended claims.

Having now described my invention, I claim:

1. A protective propeller shroud assembly for a motor driven boat, said protective propeller shroud assembly comprising:

a multibladed marine propeller rotatable about an axis of rotation and having a plurality of radially extending propeller blades, each blade having a leading blade edge, a trailing blade edge and a blade outer tip;

an open ended, generally cylindrical stationary safety shroud positioned about said propeller and having a shroud center line coincident with said propeller axis of rotation, said safety shroud having an inlet located upstream, in a direction of water flow through said propeller and said shroud, of said propeller leading blade edge at a distance of at least 0.50 inch, said safety shroud further having an exit cone having an angle of convergence of between 3.0° and 4.0°, said exit cone having an internal starting point downstream of said blade outer tips, said exit cone terminating in a shroud exit edge; and a generally horizontal control vane located in said exit cone downstream of said propeller and having an angle of declination the same as said angle of convergence of said exit cone, said control vane being located generally halfway between said safety shroud center line and an upper inner surface of said exit cone portion of said safety shroud.

2. The protective propeller shroud assembly of claim 1 wherein a radial clearance between said blade tips and said inner surface of said safety shroud is generally 0.5 inches.

3. The protective propeller shroud assembly of claim 1 wherein said internal starting point of said exit cone is generally 0.5 inches downstream of said blade outer tips.

4. The protective propeller shroud assembly of claim 1 wherein said angle of convergence and declination is 3.5°.

5. The protective propeller shroud assembly of claim 1 wherein said exit cone has a length of 4 inches.

6. The protective propeller shroud assembly of claim 1 wherein said control vane has a leading edge positioned generally 0.5 inches downstream of said propeller trailing blade edges.

* * * * *